US009080728B2

(12) United States Patent
Fukada et al.

(10) Patent No.: US 9,080,728 B2
(45) Date of Patent: Jul. 14, 2015

(54) WIPING DEVICE, INK-JET DEVICE, AND WIPING METHOD

(71) Applicant: Panasonic Corporation, Osaka (JP)

(72) Inventors: Kazuki Fukada, Osaka (JP); Teiichi Kimura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/313,038

(22) Filed: Jun. 24, 2014

(65) Prior Publication Data

US 2014/0373929 A1 Dec. 25, 2014

(30) Foreign Application Priority Data

Jun. 25, 2013 (JP) ..... 2013-132977
Mar. 11, 2014 (JP) ..... 2014-047546

(51) Int. Cl.
*B41J 2/165* (2006.01)
*F17D 5/00* (2006.01)

(52) U.S. Cl.
CPC ..... *F17D 5/00* (2013.01); *B41J 2/16535* (2013.01); *B41J 2/16552* (2013.01); *B41J 2002/16555* (2013.01); *Y10T 137/0419* (2015.04); *Y10T 137/87362* (2015.04)

(58) Field of Classification Search
CPC ..... B41J 2/165; B41J 2/16535; B41J 2/16552
See application file for complete search history.

(56) References Cited

U.S. PATENT DOCUMENTS 4,970,535 A * 11/1990 Oswald et al. ..... 347/25
2011/0074869 A1* 3/2011 Kanata et al. ..... 347/25

FOREIGN PATENT DOCUMENTS

JP 2011-088133 A 5/2011

* cited by examiner

*Primary Examiner* — Shelby Fidler
*Assistant Examiner* — Tracey McMillion
(74) *Attorney, Agent, or Firm* — Pearne & Gordon LLP

(57) ABSTRACT

A wiping device has a wiping section that relatively moves along the nozzle surface, and the wiping section has: a curved surface in which a bulge is continuously formed along the identification line; a guiding section disposed such that the bulge faces the nozzle surface; a gas jetting port that applies gas to the curved surface; and a gas suction port that sucks the gas ejected from the gas jetting port and guided along the curved surface, wherein, as viewed from the direction perpendicular to the nozzle surface, the identification line which is the set of upper end points on the bulge on the curved surface intersects with the edges of the nozzle surface at an oblique angle.

12 Claims, 8 Drawing Sheets

WIPING DEVICE, INK-JET DEVICE, AND WIPING METHOD

CROSS REFERENCE TO RELATED APPLICATIONS

The disclosure of Japanese Patent Application No. 2013-132977, filed on Jun. 25, 2013 and the disclosure of Japanese Patent Application No. 2014-047546, filed on Mar. 11, 2014 including the specification, drawings and abstract are incorporated herein by reference in their entirety.

TECHNICAL FIELD

The present invention relates to a wiping device of an ink-jet head, an ink-jet device, and a wiping method.

BACKGROUND ART

In recent years, in the manufacture of electronic devices, a method in which an application of ink containing a functional material is performed using an ink-jet head has been widely employed. The ink-jet head discharges ink to a printing target through minute nozzle holes provided in the nozzle plate.

With such an ink-jet head, part of discharged ink or foreign matters such as dust in the outside air may adhere to the nozzle surface of the nozzle plate. When such foreign matters adhere to the nozzle plate, appropriate discharging of ink is inhibited, and ink cannot be applied with high accuracy.

To solve this problem, printers provided with an ink-jet head typically have a wiping device that removes foreign matters adhered on the nozzle plate. One known wiping device employs a system in which a gas flow is applied to the nozzle surface of the nozzle plate to remove foreign matters.

In wiping devices that use a gas flow to remove foreign matters, gas is applied also to the inner part of the nozzle hole when gas is obliquely applied to the nozzle plate, and consequently, the ink inside the nozzle hole is dried, causing nozzle clogging.

Under such circumstances, some configurations have been proposed in which gas is ejected in parallel to the nozzle plate in order to remove foreign matters without causing nozzle clogging. However, in a configuration in which gas is ejected or sucked in parallel to the nozzle plate at a location below the nozzle plate, the flow velocity of gas decreases as the distance from the nozzle plate decreases, and thus a gas flow that can stably blow away the foreign matters cannot be easily obtained. In addition, a configuration may be conceivable in which part of the wiping device is brought into contract with the nozzle plate, and the gap between the nozzle surface of the nozzle plate and a surface of the wiping device is used as a gas path, whereby a gas having a high flow velocity is generated in parallel to the nozzle plate at a location directly below the nozzle plate. However, such a configuration causes a problem in which the contact wears away the water-repellent film of the nozzle plate.

Conventionally, in order to solve the above-mentioned problems, a wiping device has been proposed in which gas is guided along a curved surface by Coanda effect to generate a stable gas flow in parallel to the nozzle plate without contacting the nozzle plate (see, for example PTL 1). "Coanda effect" refers to a phenomenon in which, when an object is placed in a viscous fluid, the direction of the fluid is changed along the object.

FIG. 1 is an exploded perspective view of wiping device 210 disclosed in PTL 1, and FIG. 2 is a schematic view explanatory of a state where the wiping device of FIG. 1 wipes nozzle plate 11. FIG. 2 illustrates a cross-section taken along dashed line A0 of FIG. 1.

As illustrated in FIG. 2, in a wiping device utilizing Coanda effect, the gas ejected from gas jetting port 430 advances along a protruding curved surface of guiding section 410 so as to form a stable gas flow in parallel to nozzle plate 11. With this configuration, the foreign matters and ink drop 15 adhered on nozzle plate 11 are blown away, and sucked into gas suction port 450. In addition, since gas is not obliquely applied to nozzle plate 11 in a wiping device utilizing Coanda effect, the gas is not directed to the inner part of the nozzle hole, and therefore the nozzle hole is not clogged. Further, since such a wiping device does not make contact with nozzle plate 11, the water-repellent film on the surface of nozzle plate 11 is not worn away.

CITATION LIST

Patent Literature

PTL 1: Japanese Patent Application Laid-Open No. 2011-88133

SUMMARY OF INVENTION

Technical Problem

However, the conventional wiping device utilizing Coanda effect illustrated in FIG. 1 and FIG. 2 has the problems described below. FIG. 3 is a plan view illustrating the positional relationship of components of the wiping device of FIG. 1 and FIG. 2 (gas jetting port 430, guiding section 410, and gas suction port 450) with the nozzle plate. In FIG. 3, the reference symbol T0 (hereinafter referred to as apex line T0) denotes the line segment nearest to nozzle plate 11 on the curved surface of guiding section 410.

As illustrated in FIG. 3, in the conventional wiping device utilizing Coanda effect, gas jetting port 430 and gas suction port 450 are formed in a slit shape along apex line T0, and disposed in parallel to each other with apex line T0 therebetween. In other words, the longitudinal direction of slit-shaped gas jetting port 430 and gas suction port 450 is orthogonal to the long side of nozzle plate 11. With this configuration, the gas flow for blowing away the foreign matters adhered on nozzle plate 11 is in parallel to the long side of nozzle plate 11.

With such a configuration, it is difficult to remove the foreign matters adhered on a step or gap along the long side of nozzle plate 11, such as an edge on the long side of nozzle plate 11 and a joint of nozzle plate 11 formed in the long side direction. The reason for this is that, when the gas flow of FIG. 3 is applied to such foreign matters, the foreign matters move along the step or gap by the surface tension and turn aside the force of the gas flow, so as to avoid being detached from nozzle plate 11.

In this case, the foreign matters may be removed by increasing the flow velocity of the gas for the foreign matters adhered on the step or gap along the long side of nozzle plate 11. However, when the flow velocity of the gas is set in accordance with the step or gap along the long side of nozzle plate 11, the flow velocity of the gas excessively increases at and near nozzle hole 13, causing another problem that the inner part of nozzle hole 13 is dried.

An object of the present invention is to surely remove the foreign matters adhered on an edge of the nozzle surface or a step or gap along the side of the edge, in a wiping device and a wiping method which can generate a stable gas flow in parallel to the nozzle surface without making contact with the nozzle surface.

Solution to Problem

A wiping device according to an aspect of the present invention includes a guiding section that is a columnar member having a U-shaped form in cross-section; a gas jetting port that is located on one side of the U-shaped form of the guiding section with respect to a vertex of the U-shaped form, and ejects gas toward the vertex along the U-shaped form; and a gas suction port that is located on the other side of the U-shaped form of the guiding section with respect to the vertex of the U-shaped form, and sucks the gas from the vertex along the U-shaped form, wherein an identification line that connects the vertex of the U-shaped form includes a curved part, and both ends of the identification line form a truncated V-shape.

A wiping method according to an aspect of the present invention is a wiping method of cleaning a nozzle surface of an ink-jet head by using the wiping device, and the wiping method includes: disposing the wiping section and the ink-jet head such that the vertex of the guiding section and the nozzle surface face each other; and ejecting gas from the gas jetting port, and moving the wiping section relative to the nozzle surface while keeping a constant distance between the vertex of the guiding section and the nozzle surface, so as to remove foreign matters adhered on the nozzle surface by using a gas flow guided along the U-shaped form.

Advantageous Effects of Invention

According to the present invention, without making contact with the nozzle surface, a stable gas flow in parallel to the nozzle surface can be generated, and further, the foreign matters adhered on the edge of the nozzle surface or the step or gap along the edge can be readily removed.

DESCRIPTION OF EMBODIMENTS

In the following, embodiments of the present invention will be described in detail with reference to the accompanying drawings.

(Embodiment 1)

Figure 4:
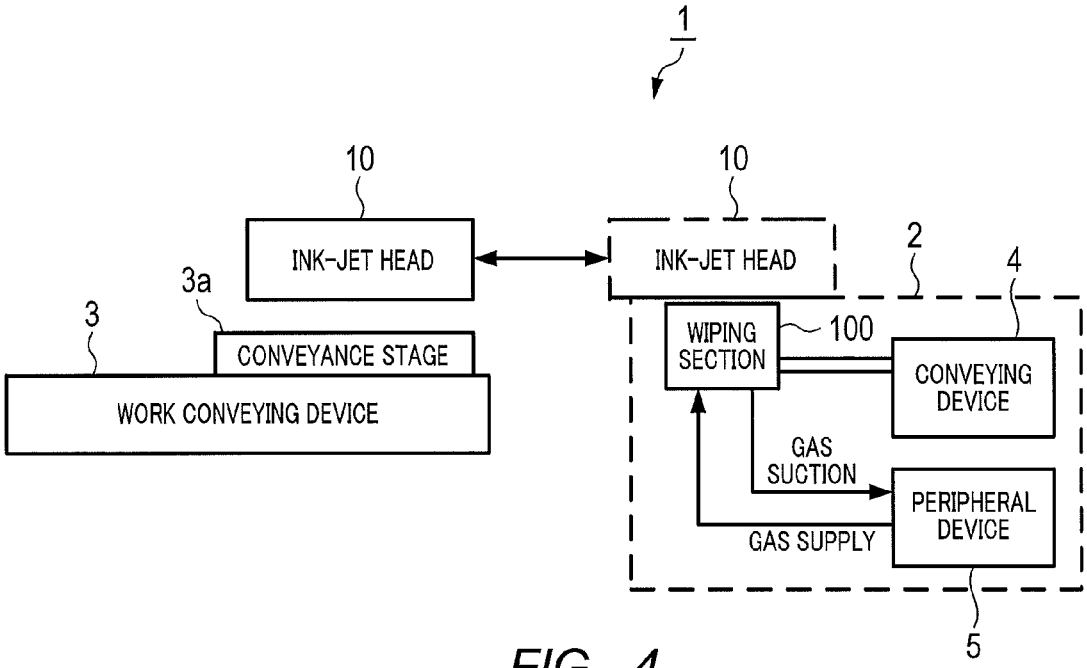
FIG. 4 is a block diagram illustrating an ink jet device of Embodiment 1 of the present invention.

FIG. 4 is a block diagram illustrating an ink-jet device 1 of Embodiment 1 of the present invention.

Ink-jet device 1 of Embodiment 1 includes wiping device 2, ink-jet head 10, and work conveying device 3 that moves an object to be printed, which is placed on conveyance stage 3*a* and ink-jet head 10 relative to each other.

Wiping device 2 of Embodiment 1 includes wiping section 100, conveying device 4 that moves wiping section 100 relative to ink-jet head 10, and peripheral device 5 that supplies gas to wiping section 100 and sucks gas from wiping section 100.

Figure 5:
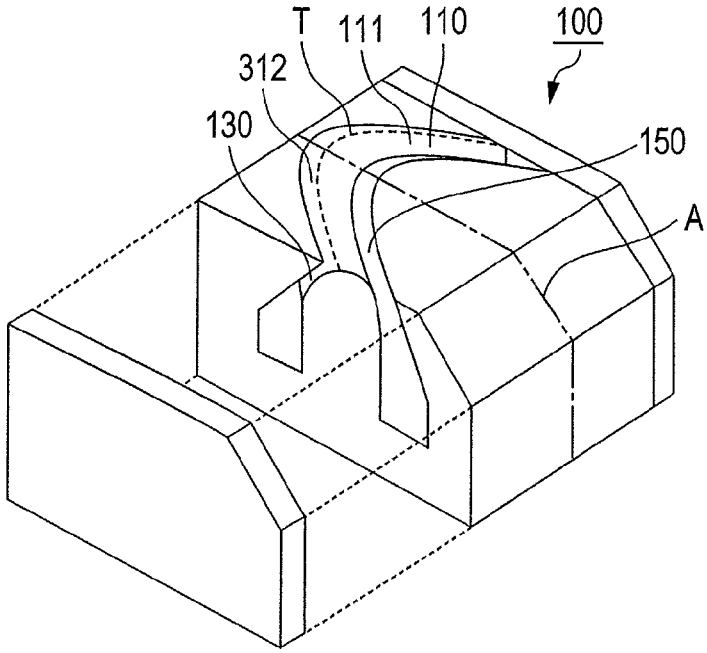
FIG. 5 is an exploded perspective view illustrating a wiping section of Embodiment 1 of the present invention.
Figure 6:
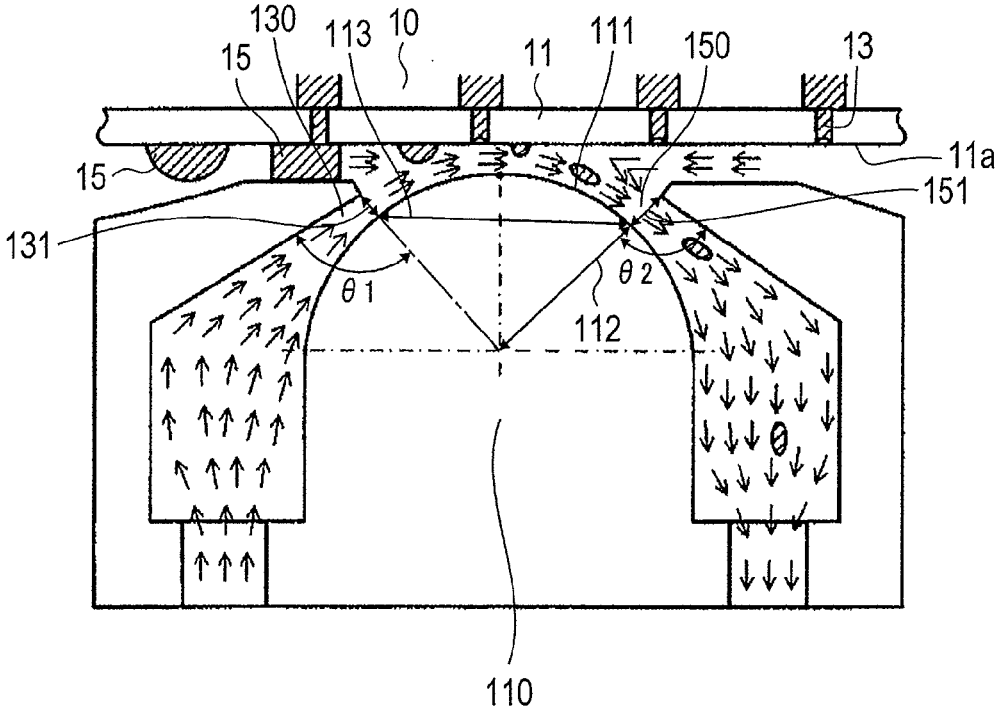
FIG. 6 is a schematic view illustrating a state where the wiping section of Embodiment 1 wipes the nozzle plate.

FIG. 5 is an exploded perspective view illustrating wiping section 100 of Embodiment 1 of the present invention. FIG. 6 is a schematic view illustrating a state where wiping section 100 of Embodiment 1 wipes ink-jet head 10. FIG. 6 illustrates a cross-section taken along dashed line A of FIG. 5. Dashed line A is a line that divides wiping section 100 perpendicularly to the nozzle surface, and divides wiping section 100 at the center in the lateral direction.

As illustrated in FIG. 5, wiping section 100 includes guiding section 110 having curved surface 111, gas jetting port 130, and gas suction port 150.

Guiding section 110 is a columnar member which has a U-shaped form in cross-section. Gas jetting port 130 that ejects gas toward the vertex of the U-shaped form of guiding section 110 is provided along one side of the U-shaped form with respect to the vertex. Gas suction port 150 that sucks gas from the vertex of the U-shaped form of guiding section 110 is provided along the other side of the U-shaped form with respect to the vertex.

The line that connects the vertex of the U-shaped form is identification line T. Identification line T includes a curved part, and both ends of identification line T form a truncated V-shape.

Curved surface 111 of guiding section 110 has a form of a curved surface in which a bulge is continuously formed along the identification line. Curved surface 111 is disposed between gas jetting port 130 and gas suction port 150, and guides gas from gas jetting port 130 to gas suction port 150 by Coanda effect. In curved surface 111, the part for guiding gas is exposed to the outside, and disposed to face nozzle plate 11.

Curved surface 111 includes identification line T of FIG. 5. Assuming that nozzle surface 11*a* side is the upside, identification line T is a line which is the set of the upper end points of the bulge of the curved surface. In other words, identification line T is a line that extends along the bulge at a location nearest to nozzle surface 11*a* on curved surface 111, a watershed of curved surface 111 when nozzle plate 11 side is the upside, or a ridgeline having no sharp point on curved surface 111 when nozzle plate 11 side is the upside.

Figure 12A:
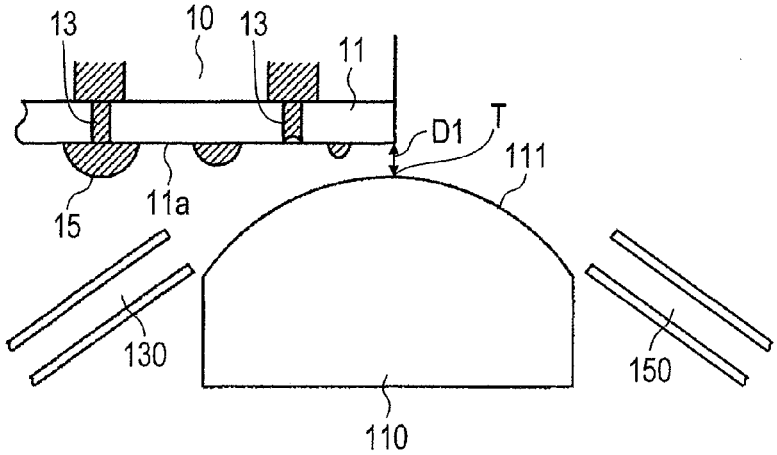
FIGS. 12A to 12C are schematic views explanatory of a procedure of a wiping process using the wiping device of Embodiment 1.

Gas jetting port 130 is a slit-shaped port that extends along identification line T. Gas jetting port 130 and identification line T are separated by substantially the same distance from one end to the other end in the longitudinal direction. While gas jetting port 130 is defined as a gap between guiding section 110 and a member that covers one side of guiding section 110 in FIG. 5, gas jetting port 130 may be independent of guiding section 110 as illustrated in FIG. 12A.

Gas suction port 150 is a slit-shaped port that extends along identification line T and is provided on the side opposite to gas jetting port 130 with identification line T therebetween. Gas suction port 150 and identification line T are separated by substantially the same distance from one end to the other end in the longitudinal direction. While gas suction port 150 is defined as a gap between guiding section 110 and a member that covers one side, of guiding section 110 in FIG. 5, gas suction port 150 may be independent of guiding section 110 as illustrated in FIG. 12A.

Wiping section 100 of FIG. 5 has, but is not limited to, a configuration in which gas jetting port 130, gas suction port 150, and guiding section 110 are integrally formed in a block. In addition, wiping section 100 has opening part 312 provided on one face of the block, and the opening of gas jetting port 130, the opening of gas suction port 150, and the part around identification line T of guiding section 110 are exposed at opening part 312.

[Relationship Between Identification Line of Curved Surface and Edges of Nozzle Plate 11]

Figure 7:
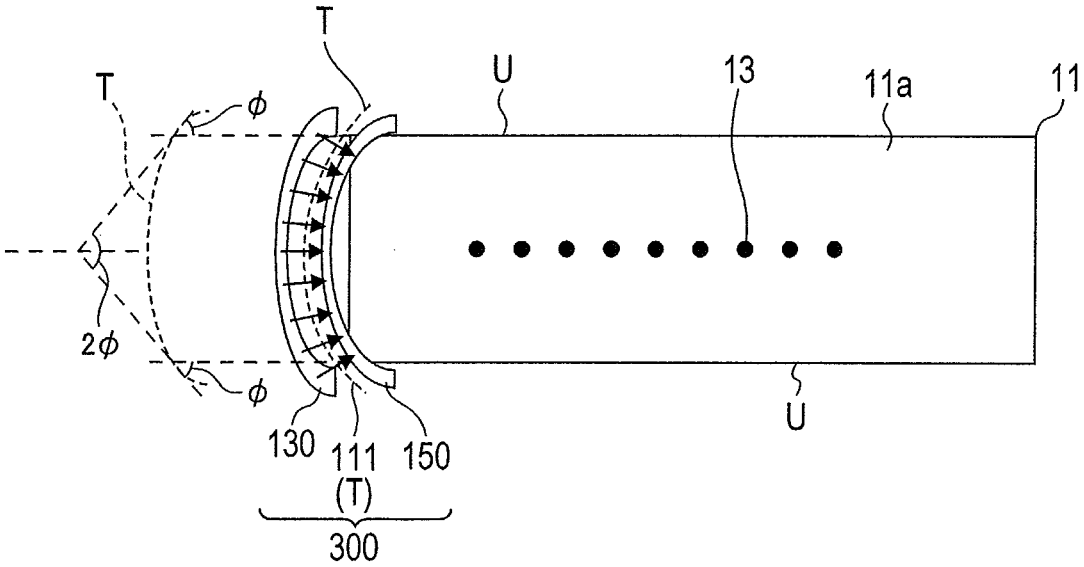
FIG. 7 is a plan view illustrating a positional relationship between a port section of the wiping section and the nozzle plate in Embodiment 1.

FIG. 7 is a plan view illustrating a positional relationship between port section 300 of the wiping section of Embodiment 1 and nozzle plate 11. Here, port section 300 includes a plurality of components (gas jetting port 130, gas suction port 150, and part of curved surface 111 for guiding gas).

Identification line T of curved surface 111 is a parabolic curved line which is substantially in parallel to nozzle surface 11*a* of nozzle plate 11, and is symmetric about the longitudinal center axis of nozzle plate 11 as viewed in a direction perpendicular to nozzle surface 11*a*, as illustrated in FIG. 7.

With the above-mentioned shape of identification line T, identification line T of curved surface 111 intersects with longitudinal edge U of nozzle plate 11 at oblique angle ϕ (see FIG. 7) as viewed in the direction perpendicular to nozzle surface 11*a*.

Angle ϕ is preferably an angle inclined by 5 degrees or more from the direction perpendicular to edge U. With such an angle, a gas flow is applied to the foreign matter adhered on longitudinal edge U in a direction oblique to the direction along edge U, and thus the foreign matter can be easily removed.

In this case, when the both ends of identification line T form a truncated V-shape, the vertical angle (angle 2ϕ of FIG. 7) at the point where the tangents to each end of the identification line intersect is 170 degrees or smaller.

More preferably, angle ϕ between identification line T and edge U of nozzle plate 11 is an acute angle smaller than 90 degrees so that the gas flow is directed toward the inside of nozzle surface 11*a* from the outside of nozzle surface 11*a*. Here, as illustrated in FIG. 7, angle ϕ is an angle between the line segment on gas suction port 150 side of edge U and the line segment of identification line T on the outside of nozzle surface 11*a*, with respect to the intersection of edge U with identification line T.

With such an angle ϕ, gas is obliquely ejected from the outside of nozzle surface 11*a* toward the inside of nozzle surface 11*a*, at edge U. Since nozzle surface 11*a* of nozzle plate 11 is a water-repellent surface, foreign matters are detached from nozzle surface 11*a* more easily than from the side surface of nozzle plate 11. With this configuration, by the above-mentioned gas flow, a force that moves the foreign matters adhered on edge U toward the inside of nozzle surface 11*a* is exerted on the foreign matters, and thus the foreign matters can be surely removed.

Specifically, angle ϕ smaller than 85 degrees is most preferable. When angle ϕ is 85 to 90 degrees, the amount of the flow velocity component directed toward the center of nozzle plate 11 from the end of nozzle plate 11 is small, and therefore there is a risk that foreign matters such as ink drop adhered on an end portion of the nozzle plate cannot be removed.

Figure 8A:
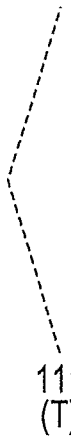
FIGS. 8A to 8C illustrate modifications of an identification line of the port section of the wiping section according to Embodiment 1.
Figure 8B:
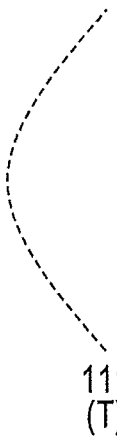
Figure 8C:
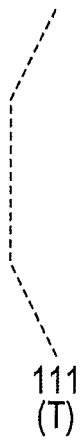

It is to be noted that the form of identification line T (curved surface 111) is not limited to the form illustrated in FIG. 7, and other forms may also be adopted. FIGS. 8A to 8C illustrate modifications of identification line T of port section 300 of the wiping section according to Embodiment 1.

The form of identification line T (curved surface 111) may be a V-form as illustrated in FIG. 8A, or a U-form as illustrated in FIG. 8B. Alternatively, as illustrated in FIG. 8C, it is possible to adopt a form composed of straight lines of the center portion and both ends in which the straight lines of the both ends are bent with respect to the straight line of the center portion.

It is to be noted that, in FIGS. 8A and 8C, all or part of the straight lines may be a curved line. When a part of the straight lines is a curved line, identification line T is a line composed a combination of a curved line and a straight line.

Identification line T may be asymmetric about the longitudinal center axis of nozzle plate 11 as viewed in the direction perpendicular to nozzle surface 11*a*. Identification line T may not be completely in parallel to nozzle surface 11*a*, and the distance between identification line T and nozzle surface 11*a* may be different in places.

Figure 9:
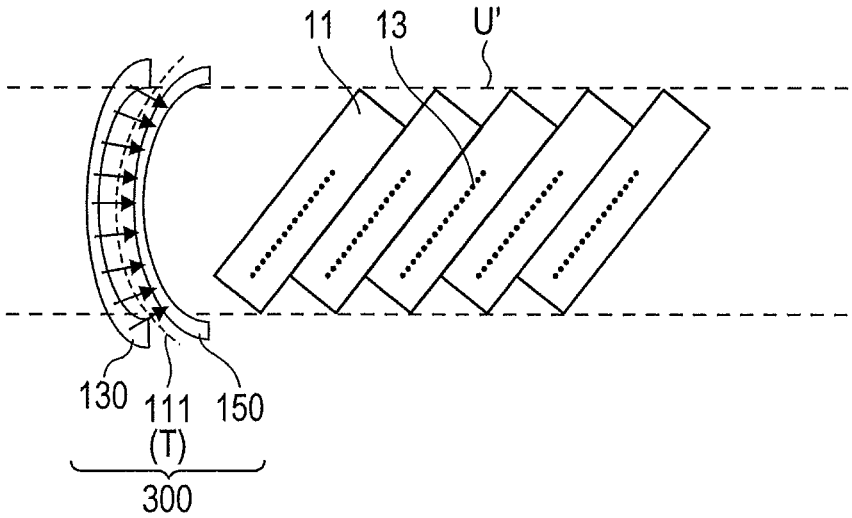
FIG. 9 illustrates a modification of Embodiment 1 where a plurality of nozzle plates are provided.

FIG. 9 illustrates a modification in which a plurality of nozzle plates 11 are provided in Embodiment 1. FIG. 9 is a plan view illustrating a positional relationship between port section 300 of the wiping section and nozzle plates 11.

In the modification illustrated in FIG. 9, a plurality of nozzle plates 11 are obliquely disposed. In this case, port section 300 of the wiping section moves along the center line that connects the centers of a plurality of nozzle plates 11. The line that connects the ends of a plurality of nozzle plates 11 (dotted line of FIG. 9) is edge U' that corresponds to edge U illustrated in FIG. 7. With this configuration, the nozzle plates can be efficiently cleaned by a movement in one direction.

Figure 10:
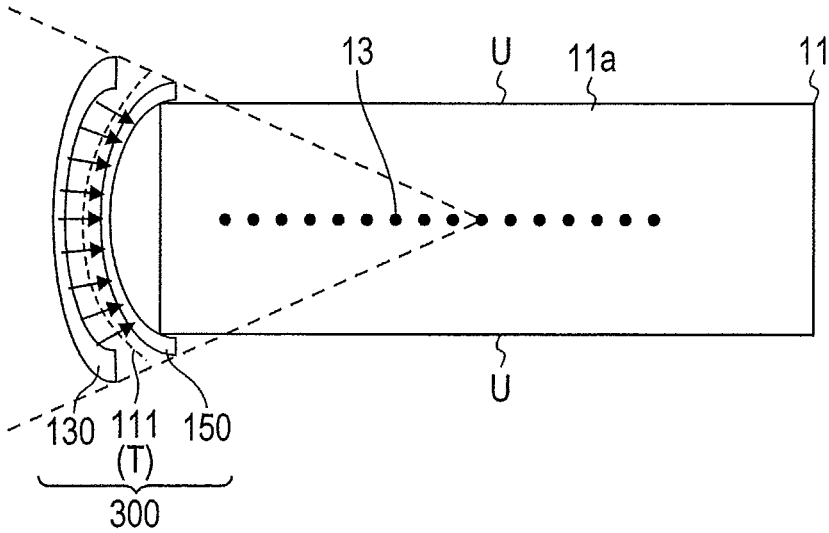
FIG. 10 illustrates a modification of the port section of the wiping section according to Embodiment 1.

FIG. 10 illustrates a modification of port section 300 of the wiping section according to Embodiment 1. Unlike port section 300 of the wiping section illustrated in FIG. 7, in port section 300 of the wiping section illustrated in FIG. 10, the length of the opening of gas suction port 150 is smaller than that of gas jetting port 130.

As a result, the area of the opening of gas suction port 150 is smaller than that of gas jetting port 130. For example, gas suction port 150 is an arc-like port having a radius smaller than that of gas jetting port 130.

Here, preferably, gas suction port 150 is formed such that the two straight lines each connecting the endpoints on the respective sides of gas suction port 150 and gas jetting port 130, and identification line T form a circular sector as illustrated by the dotted line in FIG. 10.

In this case, the difference between the area of the opening of gas suction port 150 and that of gas jetting port 130 causes a difference of atmospheric pressure, and thus gas is more easily attracted toward the inside of nozzle plate 11. As a result, edge U can be more readily cleaned. This effect is significant particularly at edge U.

Figure 11:
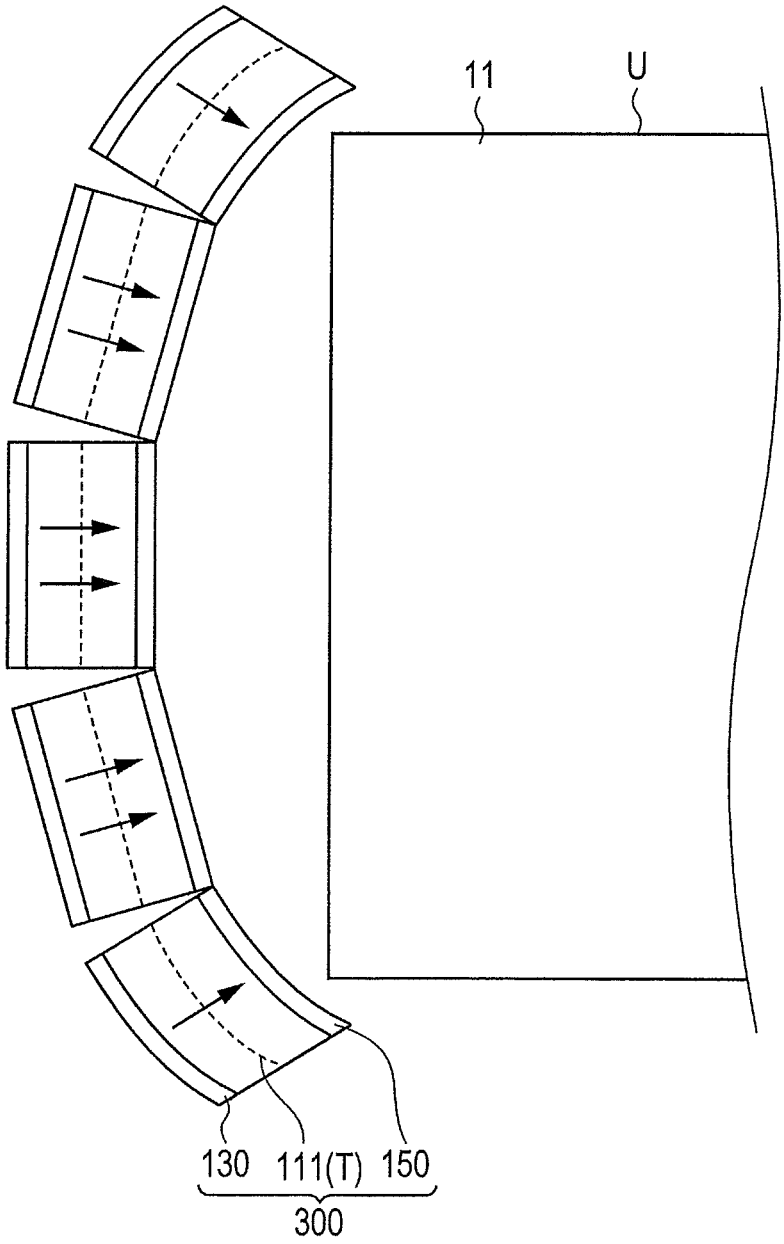
FIG. 11 illustrates a modification in which a combination of a plurality of wiping sections is adopted.

FIG. 11 illustrates a modification in which a combination of a plurality of wiping sections is adopted. In particular, this configuration is effective in the case where the size of nozzle plate 11 is large.

Here, as illustrated in FIG. 11, port section 300 for cleaning edge U is preferably curved. Other port sections 300 may be straight.

Port sections 300 illustrated in FIG. 7 and FIG. 8 may be composed of a plurality of wiping sections. With such configurations, nozzle plates of greater sizes can be efficiently cleaned.

[Curvature of Curved Surface and Incident Angle of Gas]

As illustrated in FIG. 6, curved surface 111 of guiding section 110 is formed such that curvature radius 112 is 5 mm to 200 mm as viewed in a cross-section along the flow of gas. In addition, the length of chord 113 that connects the point where the gas of gas jetting port 130 firstly hits curved surface 111 and the point where the gas is sucked into gas suction port 150 is 5 mm to 60 mm.

It is to be noted that curvature radius 112 of curved surface 111 may either be fixed or gradually varied within the above-mentioned range. For example, in curved surface 111, the curvature radius in the region on gas jetting port 130 side relative to identification line T may be equal to or smaller than the curvature radius in the region on gas suction port 150 side relative to identification line T, and also with such a configuration, curved surface 111 can guide gas by Coanda effect.

Width 131 in the short direction of gas jetting port 130, and width 151 in the short direction of gas suction port 150 are each 0.2 mm to 3.0 mm.

In addition, in order to cause Coanda effect, gas jetting port 130 is adjusted such that incident angle θ0 (=180°−θ1, see FIG. 6) of the ejected gas relative to curved surface 111 is 30 to 90 degrees. Here, "incident angle θ of the ejected gas" means the angle between the outward normal of curved surface 111 at the point where the gas ejected from gas jetting port 130 firstly hits curved surface 111 and the direction in which the gas is ejected.

Further, in order to cause Coanda effect, gas suction port 150 is adjusted such that suction angle θ (180°−θ2, see FIG. 6) of the sucked gas relative to curved surface 111 is 30 to 90 degrees. Here, "suction angle θ of the sucked gas" means the angle between the outward normal of curved surface 111 at the point where the gas sucked into gas suction port 150 is lastly detached from curved surface 111 and the direction in which the gas is sucked.

When incident angle θ of the ejected gas is greater than 90 degrees, the amount of the component of the gas flow along curved surface 111 is small, and the gas does not efficiently flow along the curved surface. It is to be noted that incident angle θ on gas jetting port 130 side and suction angle θ on gas suction port 150 side may not necessarily be the same.

When incident angle θ of the ejected gas is smaller than 30 degrees, the curvature radius of curved surface 111 is required to be reduced, and when the curvature radius is reduced, gas is not easily guided along curved surface 111.

With incident angle θ of the ejected gas set at 30 to 90 degrees, Coanda effect can be stably caused, and gas can be stably guided along curved surface 111.

[Wiping Process]

Next, a method for wiping nozzle plate 11 using the wiping device of Embodiment 1 will be described.

Figure 12B:
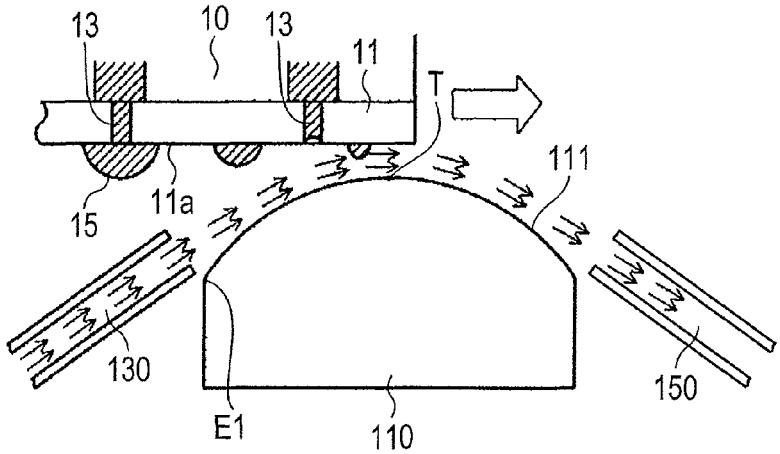
Figure 12C:
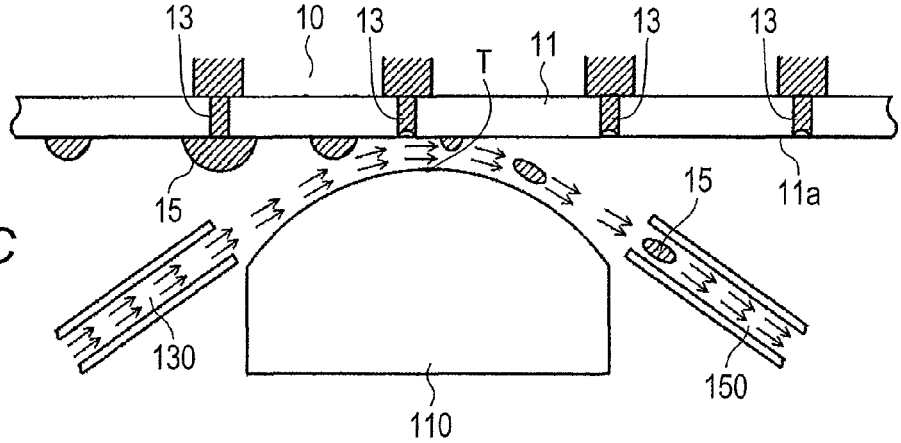

FIG. 12A to FIG. 12C are schematic views explanatory of steps of the wiping process of nozzle plate 11 using the wiping device of Embodiment 1.

The wiping method of the present embodiment includes a first step in which, first, as illustrated in FIG. 12A, ink-jet head 10 is disposed above wiping section 100 such that curved surface 111 and nozzle plate 11 face each other.

In the first step, ink-jet head 10 is disposed above wiping section 100 such that curved surface 111 of wiping section 100 and nozzle plate 11 of ink-jet head 10 face each other. Curved surface 111 and nozzle plate 11 are separated from each other, and distance D1 is provided therebetween. As foreign matters, ink drop 15, for example, is adhered on nozzle plate 11.

It is to be noted that, while wiping section 100 is disposed below nozzle plate 11 in the gravity direction in FIG. 12A, wiping section 100 may be disposed above nozzle plate 11 in the gravity direction, since the above-described Coanda effect is stronger than the influence of gravity.

The wiping method of the present embodiment includes a second step in which, as illustrated in FIG. 12B and FIG. 12C, gas is ejected from gas jetting port 130, and wiping section 100 is moved relative to nozzle plate 11 while keeping constant distance D1 between curved surface 111 and nozzle plate 11. The process of the second step is carried out after the above-described first step.

In the second step, wiping section 100 is moved by conveying device 4 (see FIG. 4) relative to nozzle plate 11. This relative movement may be achieved by moving ink-jet head 10 (nozzle plate 11) with wiping section 100 fixed, or by moving wiping section 100. Alternatively, the relative movement may be achieved by moving both of wiping section 100 and ink-jet head 10.

As illustrated in FIG. 12B and FIG. 12C, the gas ejected from gas jetting port 130 is directed toward identification line T of curved surface 111 from end portion E1 on one side of curved surface 111, guided along curved surface 111 by Coanda effect, and then sucked into gas suction port 150.

Distance D1 between curved surface 111 and nozzle plate 11 is set such that the gas flow along curved surface 111 reaches nozzle plate 11. Specifically, distance D1 is preferably about 0.2 mm to 1.5 mm. When distance D1 is smaller than 0.2 mm, there is a risk that the curved surface and the nozzle plate make contact with each other during the relative movement of the wiping device. On the other hand, when distance D1 is greater than 1.5 mm, the gas flow and nozzle plate 11 are separated from each other, and thus ink drop 15 cannot be blown away.

In the second step, longitudinal edge U of nozzle plate 11 (see FIG. 7) and identification line T of curved surface 111 are set so as to obliquely cross each other at angle ϕ, as viewed in the direction perpendicular to nozzle surface 11*a*. With this configuration, at longitudinal edge U of nozzle plate 11, a gas flow directed toward the inside of the long side of nozzle plate 11 from the outside of the long side of nozzle plate 11 is generated. With this gas flow, the foreign matters adhered on edge U are surely blown away and sucked into gas suction port 150.

Figure 1:
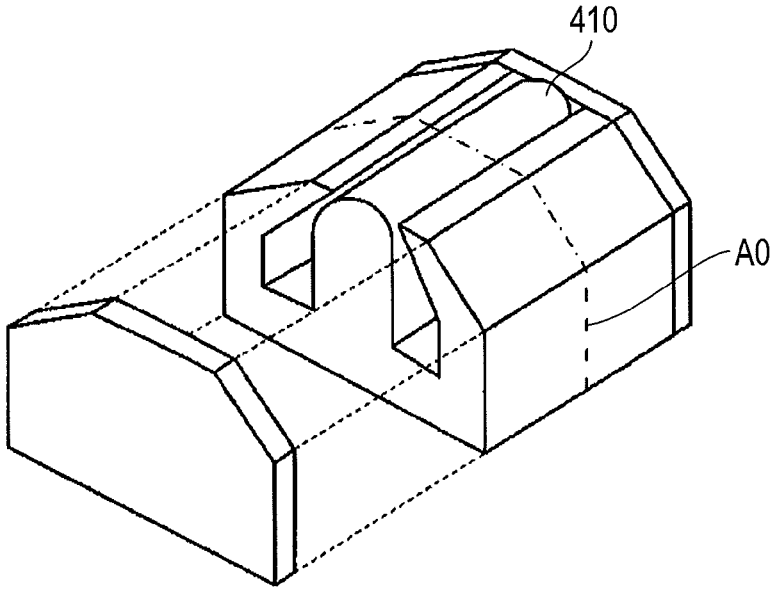
PRIOR ART FIG. 1
FIG. 1 is an exploded perspective view illustrating an exemplary conventional wiping device.
Figure 2:
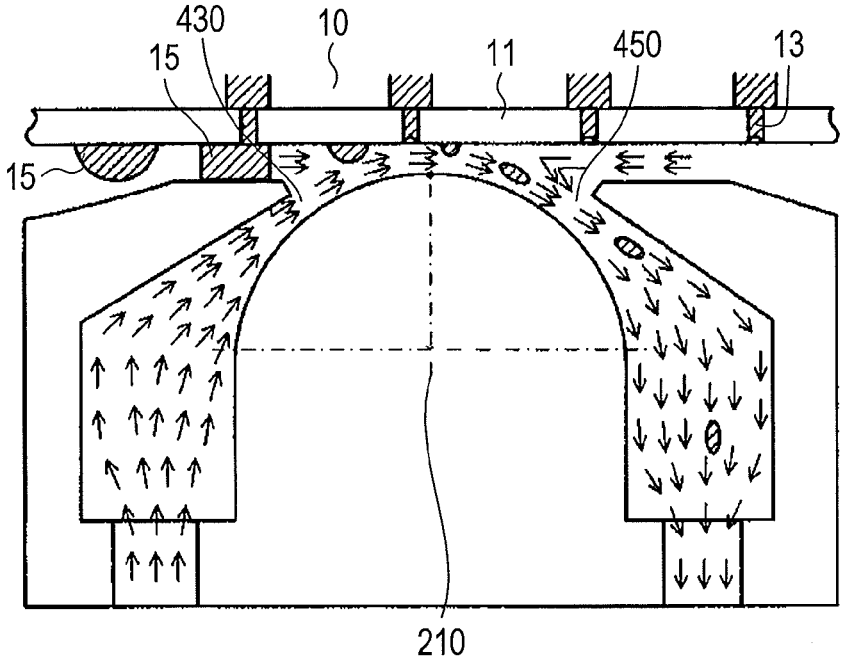
PRIOR ART FIG. 2
FIG. 2 is a schematic view illustrating a wiping operation of the conventional wiping device of FIG. 1.
Figure 3:
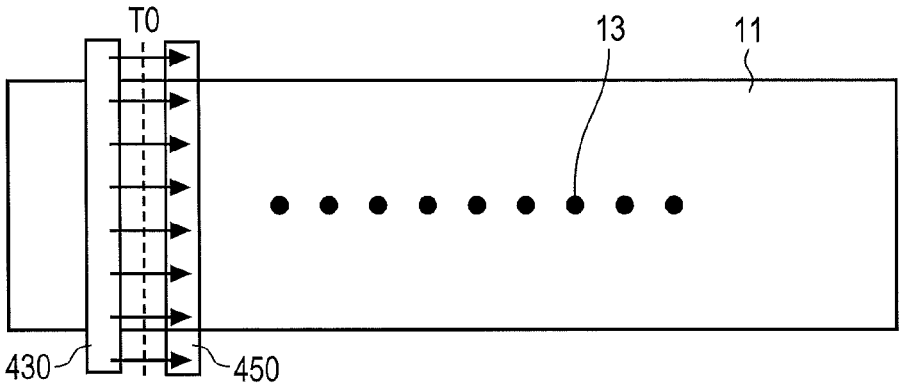
PRIOR ART FIG. 3
FIG. 3 is a plan view illustrating a positional relationship of the components of the wiping device of FIG. 1 with a nozzle plate.

Here, the conventional example illustrated in FIG. 1 to FIG. 3 and the present Embodiment 1 are compared. As illustrated in FIG. 1 to FIG. 3, in the conventional wiping device having simple cylindrical guiding section 110, a gas flow along the long side of nozzle plate 11 is applied to the foreign matters adhered on the edge of the long side of nozzle plate 11. Foreign matters adhered on the edge are strongly influenced by the surface tension, and therefore are difficult to remove in comparison with those adhered on the center portion of nozzle plate 11. For this reason, in the conventional wiping device, the foreign matters adhered on the edge are only moved along the edge, and are not easily removed from nozzle plate 11.

In contrast, the gas flow applied to nozzle plate 11 in Embodiment 1 includes a flow velocity component directed toward the center of nozzle plate 11 from the end of nozzle plate 11. Thus, a force directed toward the center of nozzle surface 11*a* is exerted on the foreign matters adhered on edge U of nozzle plate 11. Nozzle surface 11*a* is a water-repellent surface, and therefore, by only slightly moving the foreign matters toward the center of nozzle surface 11*a*, the foreign matters are detached and removed from nozzle surface 11*a*.

In the second step, the gas flow that flows along curved surface 111 is in parallel to nozzle plate 11 in the region where the gas flow reaches nozzle plate 11. Thus, as with the case of the conventional wiping device using Coanda effect (FIG. 1 to FIG. 3), the gas does not advance to the inner part of nozzle hole 13, and nozzle hole 13 is not easily dried.

In addition, the flow velocity of the gas flow that reaches nozzle plate 11 is controlled by the flow velocity of the gas ejected from gas jetting port 130 and the flow velocity of the gas sucked into gas suction port 150.

Thus, the flow velocity of the gas flow that reaches nozzle plate 11 in the present embodiment is not influenced by the form of nozzle plate 11. With this configuration, the flow velocity of gas is not reduced at the end of nozzle plate 11 and the joint of nozzle plate 11. Consequently, even in the case where the ink-jet device has a large head composed of a plurality of ink-jet heads, the entirety of nozzle plate 11 can be surely wiped.

The flow velocity of the gas ejected from gas jetting port 130 is preferably 15 m/sec or greater. With this flow velocity, the foreign matters adhered on nozzle plate 11 can be surely removed.

(Embodiment 2)

Figure 13:
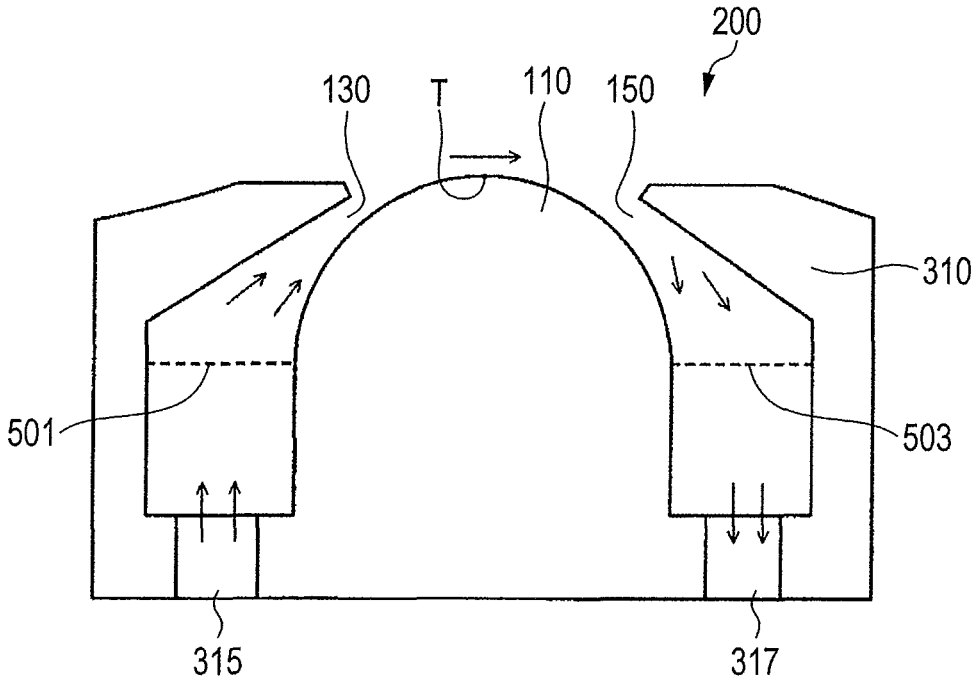
FIG. 13 is a schematic view illustrating a cross-section of a wiping section of Embodiment 2.

FIG. 13 is a schematic view illustrating a cross-section of wiping section 200 of Embodiment 2. The components same as those of wiping section 100 of Embodiment 1 are denoted by the same reference symbols, and the description thereof is omitted.

As illustrated in FIG. 13, wiping section 200 of the present embodiment includes diffusion plate 501 disposed in gas jetting port 130 and diffusion plate 503 disposed in gas suction port 150. Each of diffusion plates 501 and 503 is provided so as to cover the entirety of a cross-section of the gas flow path.

Diffusion plates 501 and 503 have a large number of holes each having a diameter of 3 to 10 mm. The holes of diffusion plates 501 and 503 may either be uniformly or non-uniformly provided over diffusion plates 501 and 503.

To be more specific, the arrangement pitch of the holes at the center portion of diffusion plates 501 and 503 (the position near gas supply port 315, or gas exhaust port 317, for example) may be smaller than the arrangement pitch of the holes at the end portion of diffusion plates 501 and 503 (the position near housing 310).

In addition, the holes provided at the end portion of diffusion plates 501 and 503 may have a form which causes smaller pressure drop in comparison with the pressure drop caused at the holes provided at the center portion of diffusion plates 501 and 503. By increasing the opening width, or by reducing the depth length of the holes at the end portion of diffusion plates 501 and 503, it is possible to make the pressure drop at the end portion smaller in comparison with the center portion.

Thus, the distribution of the gas flow velocity at gas jetting port 130 and gas suction port 150 can be uniformized. Additionally, a filter having different filtration performances among points in its plane may be disposed in gas supply port 315 and gas exhaust port 317.

Figure 14:
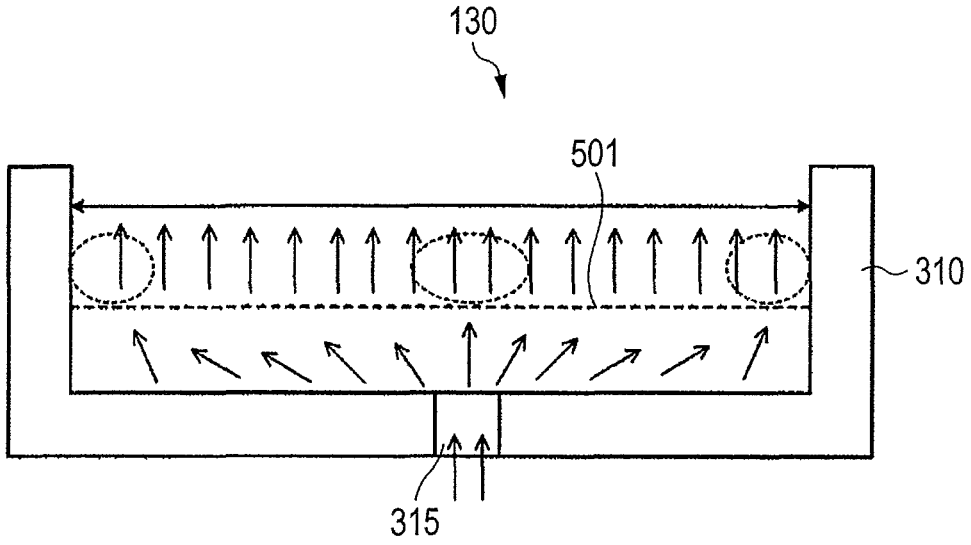
FIG. 14 is a schematic view explanatory of an operation of a diffusion plate of FIG. 13.

FIG. 14 is a schematic view explanatory of the operation of diffusion plate 501. As illustrated in FIG. 14, gas is non-uniformly supplied from gas supply port 315 toward gas jetting port 130. However, according to the wiping device of Embodiment 2, the flow velocity distribution of the gas flow in gas jetting port 130 can be uniformized by diffusion plate 501. Thus, the gas flow guided to guiding section 110 of wiping section 200 becomes more uniform over the range from one end to the other of identification line T (see FIG. 7). Consequently, the foreign matters of nozzle plate 11 can be removed more stably.

Hereinabove, the embodiments of the present invention have been described.

It is to be noted that air, nitrogen, solvent vapor of the ink contained in the ink-jet head, or the like may be adopted as the gas described in the above-mentioned embodiments. When solvent vapor is adopted as the gas to be ejected, the ink in nozzle hole 13 can be more surely prevented from being dried.

In addition, in the cross-section along the flow of gas, the gas jet side and the gas suction side of curved surface 111 of guiding section 110 may either be symmetric or asymmetric about identification line T.

[Outline of the Present Disclosure]

In the following, the outline of the present disclosure will be described with reference to FIGS. 5 to 13. The reference symbols of the components in the embodiments are given to the corresponding components with parentheses.

1. Wiping Device of the Present Disclosure

The wiping device of the present disclosure 1 has wiping section (100) that relatively moves along nozzle surface (11*a*), and wiping section (100) has: curved surface (111) in which a bulge is continuously formed along identification line (T); guiding section (110) disposed such that the bulge faces nozzle surface (11*a*); gas jetting port (130) that applies gas to curved surface (111); and gas suction port (150) that sucks the gas ejected from gas jetting port (130) and guided along curved surface (111), wherein, as viewed from the direction perpendicular to nozzle surface (11*a*), identification line (T) which is the set of upper end points on the bulge on curved surface (111) intersects with edges (U) of nozzle surface (11*a*) at oblique angle (ϕ).

With this configuration, the gas flow is obliquely applied to the edge of the nozzle surface, and thus the foreign matters adhered on the edge can be readily removed.

Further, in the wiping device of present disclosure 2, the intersection angle (ϕ) is an angle which is inclined from direction perpendicular to the edge by 5 degrees or more.

With this configuration, an oblique gas flow can be surely applied to the edge of the nozzle surface.

Further, in the wiping device of present disclosure 3, the intersection angle (ϕ) is an angle which is inclined from direction perpendicular to the edge by 5 degrees or more, and is inclined such that the flow of the gas passing through the identification line (T) is directed toward the inside of the nozzle surface from the outside of the nozzle surface.

With this configuration, the gas flow applied to the edge of the nozzle surface includes a component directed toward the inside of the nozzle surface from the outside of the nozzle surface, and thus the foreign matters adhered on the edge can be removed more surely.

Further, in the wiping device of present disclosure 4, as viewed from the direction perpendicular to the nozzle surface, the identification line (T) is a curved line, a straight line including a bend, or a line including a curved line and a straight line.

With this configuration, gas flows in symmetric directions can be applied to the two opposite edges of the nozzle surface. In addition, a configuration in which a gas flow in desired direction can be applied to each point on the nozzle surface can be achieved.

Further, in the wiping device of present disclosure 5, an opening area of gas suction port (150) is smaller than an opening area of gas jetting port (130).

With this configuration, at an edge in particular, gas is easily guided to the inside of the nozzle plate by the space defined by the gas suction port and the gas jetting port. As a result, the edge can be cleaned more easily.

Further, in the wiping device of present disclosure 6, the curvature radius of the curved surface (111) is 5 mm to 200 mm.

With this configuration, a gas flow can be more surely guided to the curved surface of the guiding section by Coanda effect. Further, the size of the wiping section is not excessively increased.

Further, in the wiping device of present disclosure 7, with respect to an outward normal vector of the curved surface (111), an incident angle of gas incident on the curved surface (111) from the gas jetting port (130) is 30 to 90 degrees.

With this configuration, a gas flow can be more surely guided to the curved surface of the guiding section by Coanda effect.

Further, in the wiping device of present disclosure 8, gas jetting port (130), and gas suction port (150) each have a slit-shape along the identification line (T).

With this configuration, a gas flow can be generated over the entire region in the short side direction of the nozzle surface. Consequently, by only conveying the wiping section in the long side direction relative to the nozzle surface, the entirety of the nozzle surface can be cleaned.

Further, in the wiping device of present disclosure 9, the wiping section (200) further includes diffusion plates (501, 503) that change a distribution of a gas flow, and diffusion plates (501, 503) are disposed in a gas flow path in the gas jetting port (130), and in a gas flow path in the gas suction port (150), respectively.

With this configuration, an appropriate gas flow can be generated over the range from one end to the other end of identification line T.

2. Ink-Jet Device of the Present Disclosure

The ink-jet device of present disclosure 10 is an ink-jet device that includes any one of the wiping devices of present disclosures 1 to 9.

With this configuration, it is possible to prevent foreign matters on the nozzle surface from degrading the ink discharging performance, and thus a high ink discharging performance can be achieved.

It is to be noted that the ink-jet device may include two or more ink jet heads. In addition, the ink-jet device may include, in addition to the wiping device and the ink-jet head, a driving mechanism or a control mechanism for relatively moving application target objects.

3. Wiping Method of the Present Disclosure

The wiping method of present disclosure 11 is a wiping method of cleaning a nozzle surface of an ink-jet head by using the wiping device according to present disclosure 1, the wiping method including: disposing the wiping section and the ink-jet head such that the curved surface of the guiding section and the nozzle surface face each other; and ejecting gas from the gas jetting port, and moving the wiping section relative to the nozzle surface while keeping a constant distance between the curved surface of the guiding section and the nozzle surface, so as to remove foreign matters adhered on the nozzle surface by using a gas flow guided along the curved surface.

With this method, by utilizing Coanda effect, foreign matters can be efficiently removed by generating a gas flow in parallel to the nozzle surface. In addition, the foreign matters adhered on the edge of the nozzle surface can also be efficiently removed.

In the wiping method of present disclosure 12, a flow velocity of gas ejected from the gas jetting port is equal to or greater than 15 m/sec.

With this method, the foreign matters adhered on the nozzle surface and the edge of the surface can be efficiently removed.

In the wiping method of present disclosure 13, a distance between the curved surface and the nozzle surface is 0.2 mm to 1.5 mm.

With this method, the foreign matters adhered on the nozzle surface and the edge of the surface can be efficiently removed.

INDUSTRIAL APPLICABILITY

The wiping device of the embodiments of the present invention can be used for wiping an ink-jet head, a slit die head, and a head of a dispenser coater of the multiple nozzle system and the like, which discharge ink containing a functional material in a printing process or a device manufacturing process.

REFERENCE SIGNS LIST

1: Ink-jet device
2: Wiping device
3: Work conveying device
4: Conveying device
5: Peripheral device
10: Ink-jet head
11: Nozzle plate
11*a*: Nozzle surface
13: Nozzle hole
100, 200: Wiping section
110: Guiding section
111: Curved surface
130: Gas jetting port
150: Gas suction port
300: Port section
312: Opening part
501, 503: Diffusion plate
T: Identification line
U: Edge of nozzle surface
U': Edge of nozzle surface
ϕ: Angle between edge of nozzle surface and identification line T

The invention claimed is:

1. A wiping device comprising:

a guiding section that is a columnar member having a U-shaped form in cross-section;

a gas jetting port that is located on one side of the U-shaped form of the guiding section with respect to an identification line of the U-shaped form, and ejects gas toward the identification line along the U-shaped form; and a gas suction port that is located on the other side of the U-shaped form of the guiding section with respect to the identification line of the U-shaped form, and sucks the gas from the identification line along the U-shaped form, wherein the identification line that connects vertexes along of the U-shaped form, the identification line includes a curved part, and both ends of the identification line form a truncated V-shape.

2. The wiping device according to claim 1, wherein a vertical angle at a point where tangents to each end of the identification line intersect is 170 degrees or smaller.

3. The wiping device according to claim 1, wherein the identification line is a curved line, a straight line including a bend, or a line including a curved line and a straight line.

4. The wiping device according to claim 1, wherein an opening area of the gas suction port is smaller than an opening area of the gas jetting port.

5. The wiping device according to claim 1, wherein a curvature radius of each of the vertexes of the U-shaped form is 5 mm to 200 mm.

6. The wiping device according to claim 1, wherein, with respect to an outward normal vector of the U-shaped form, an incident angle of gas incident on each of the vertexes of the U-shaped form from the gas jetting port is 30 to 90 degrees.

7. The wiping device according to claim 1 further comprising a diffusion plate that changes a distribution of a gas flow, the diffusion plate being disposed in a gas flow path in the gas jetting port, or in the gas flow path in the gas jetting port and a gas flow path in the gas suction port.

8. A wiping device comprising:

a wiping section that relatively moves along a nozzle surface;

a guiding section that is a columnar member having a U-shaped form in cross-section;

a gas jetting port that is located on one side of the U-shaped form of the guiding section with respect to an identification line of the U-shaped form, and ejects gas toward the identification line along the U-shaped form; and a gas suction port that is located on the other side of the U-shaped form of the guiding section with respect to the identification line of the U-shaped form, and sucks the gas from the identification line along the U-shaped form, wherein the identification line connects vertexes along the U-shaped form, and as viewed from a direction perpendicular to the nozzle surface, the identification line intersects with edges of the nozzle surface at an oblique angle.

9. An ink-jet device comprising the wiping device according to claim 1.

10. A wiping method of cleaning a nozzle surface of an ink-jet head by using the wiping device according to claim 8, the wiping method comprising:

disposing the wiping section and the ink jet head such that the vertex of the guiding section and the nozzle surface face each other; and ejecting gas from the gas jetting port, and moving the wiping section relative to the nozzle surface while keeping a constant distance between the vertex of the guiding section and the nozzle surface, so as to remove foreign matters adhered on the nozzle surface by using a gas flow guided along the U-shaped form.

11. The wiping method according to claim 10, wherein a flow velocity of gas ejected from the gas jetting port is equal to or greater than 15 m/sec.

12. The wiping method according to claim 10, wherein a distance between the U-shaped form and the nozzle surface is 0.2 mm to 1.5 mm.

* * * * *